United States Patent [19]

Chen

[11] Patent Number: 4,575,872

[45] Date of Patent: Mar. 18, 1986

[54] NECKTIE

[76] Inventor: Cheng C. Chen, 3Fl. 79, Chi Lin Rd., Taipei, Taiwan

[21] Appl. No.: 723,867

[22] Filed: Apr. 16, 1985

[51] Int. Cl.[4] ..... A41D 25/02

[52] U.S. Cl. ..... 2/144; 2/150

[58] Field of Search ..... 2/144, 150, 152 R, 152 A, 2/153

[56] References Cited

U.S. PATENT DOCUMENTS

| | | | |
|---|---|---|---|
| 1,086,493 | 2/1914 | Wechsler | 2/150 X |
| 1,493,085 | 5/1924 | Sulecio | 2/150 |
| 2,172,849 | 9/1939 | Peters | 2/150 |
| 3,955,217 | 5/1976 | Levy | 2/150 |
| 4,173,792 | 11/1979 | Intengan | 2/144 |

*Primary Examiner*—Louis K. Rimrodt

*Attorney, Agent, or Firm*—Holman & Stern

[57] ABSTRACT

Improved structure of the necktie, incorporating an interim gap on top of the cravat section, to permit passage of the strap tongue whereby the suspension length can be adjusted at will; a pair of snatch laps each extending from either corner on the base of the cravat, serving to fix the setting of the necktie to the collar and to shape the cravat; a fastening belt attached to either corner on the top of the cravat, to enclose the nape of the user by button-coupling; permitting convenient adjustment of the standing length of the strap tongue and of the size of the cravat anytime.

2 Claims, 5 Drawing Figures

NECKTIE

BACKGROUND OF THE INVENTION

Along with technological advancements in our times, people have become more and more demanding on the quality of living standards, in the respect of wear, people not only placed emphasis on the quality of the garment and textiles, on the fashionability of a garment, but also begin to ask for convenience and comfortability in the design to meet the busy world that runs from day to day. In formal occasions in our society, necktie has already become a necessary accessory, yet a necktie todate is typically made of a long strap of fabric or pertinent substances, and has long been found to be subject to a number of disadvantages:

1. to wear a necktie, the user will have to enclose it around the neck, now since that the part of a necktie that needs to be exhibited consists of the cravat and that portion extending down the cravat only, so that part surrounding the nape appears to be a waste of material, in addition to causing much discomforts to the wearer;

2. that a necktie has to be worn around the neck and knotted into a cravat has restricted the use of material to the softer ones like cloth, silk, plush, flannel, and those by description terminating on lons or nons.

3. that it requires some skill to knot a necktie for wearing around the neck, those who are not accustomed to wearing a necktie can often show so much clumsiness in knotting a necktie, coming off too short or long in spite of a number of repeated necktying, and eventually just as much clumsiness when appeared wearing such a necktie, in occasions in spite of themselves;

4. the size of the cravat knotted to formation from a conventional necktie being dependent upon the material of the necktie and the mode of tying, such that a cravat, once accomplished, will deny efforts and endeavours orientated to an adjustment of the necktie unless it is undone completely in the absence of the public.

So proposals were made previously in view of the foregoing disadvantages relating to the wearing of a necktie, which come as a necktie of fixed cravat purporting that the user will simply have to hang it on the neck when need be, still, such a modification has been found to suffer from the following shortcomings:

1. fixed, inflexible structure rendering it impossible to effect an adjustment of the length of the necktie when felt like to do so by the user to best fit his stature;

2. fixed, inflexible structure together with unalterable color setting of the necktie and the cravat section failing to accommodate to a change of the color setting as might be preferred from occasion to occasion.

In view of all of the disadvantages found with the use of a necktie, of an improved one provided according to previous executions defined in the foregoing, the inventor started to work for a revolutionary improvement thereof, and finally worked out such one introduced as the subject invention.

Accordingly, a primary objective of the present invention is to provide such an improvement of necktie which permits free adjustment of the size of the cravat as well as convenience in use.

A further objective of the invention is to provide such an improvement of the necktie that permits free adjustment of the length of the tongue, that is, that portion of the necktie extending down the cravat, at the discretion of the user.

A further objective of the invention is to provide such an improvement of the necktie that permits replacement of the suspending tongue by the cravat so that the color of either the tongue or the cravat section may be matched as preferred by the user in any occasion.

SUMMARY OF THE INVENTION

Improvement of the necktie structure, comprising the cravat section and the suspending tongue section, characterised in the provision of an interim gap on the cravat to permit passage and adjustment of the strap that constitutes the tongue, and of a snatch lap down either lower end of the cravat, with the frontal side of one such snatch lap provided with a row of button, the backside of the other snatch lap provided with a row of counter-buttion to receive the button by coupling, also with fastening belts provided on either of the top ends of the cravat to fasten the buttons and counter-buttons respectively, such an arrangement ensures prompt necktying, fitting of the strap tongue, as well as adjustment of the cravat, and will also make available the use of the strap tongue on either side.

DESCRIPTION OF THE PREFERRED EMBODIMENT

Figure 1:
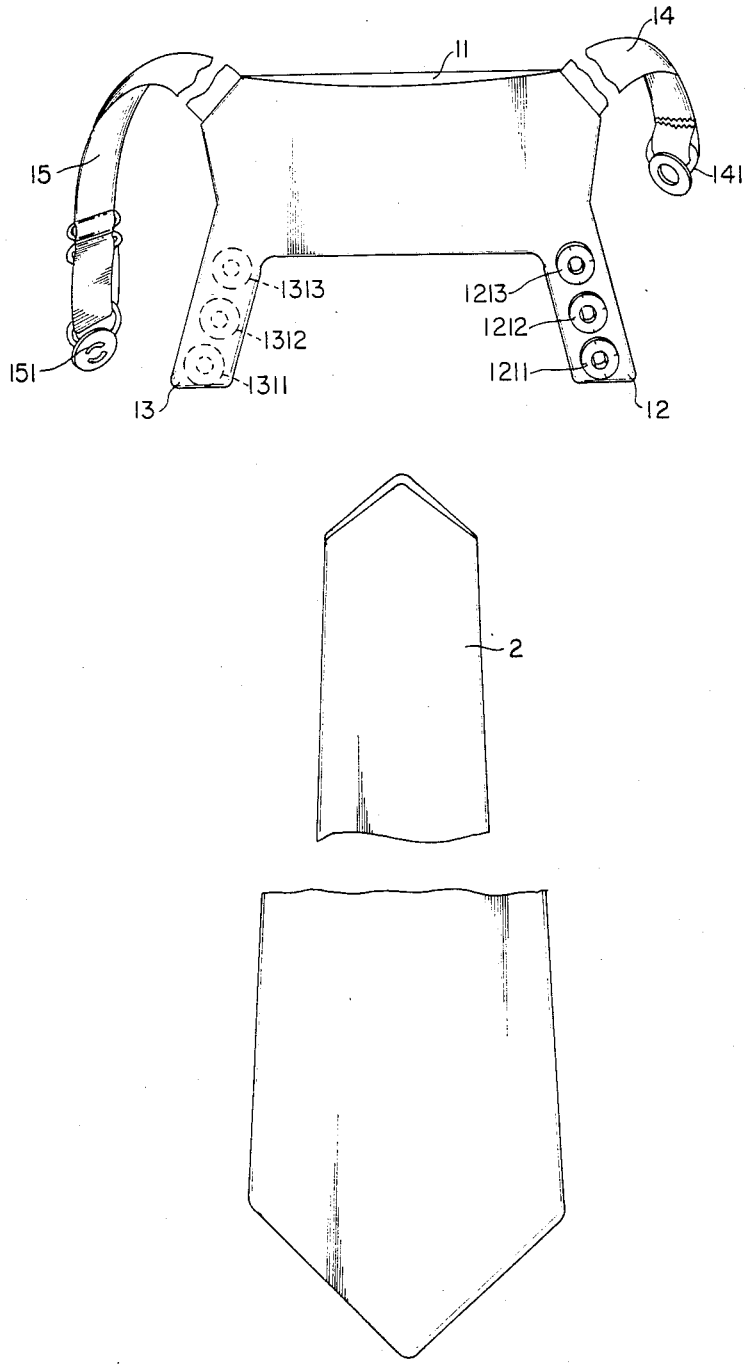
FIG. 1 is a break-away perspective of the elements constituting the invention.
Figure 2:
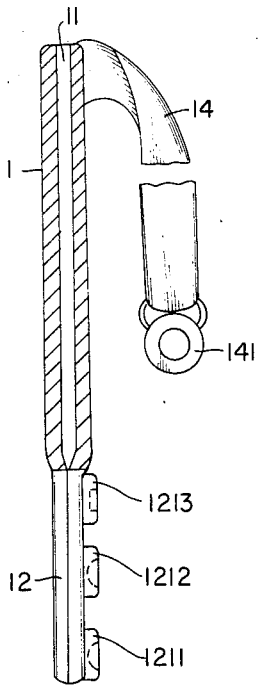
FIG. 2 is a structural perspective of the improved necktie according to the invention.

Referring to FIG. 1 and FIG. 2 it will be seen that on the cravat (1) of the subject necktie is provided an interim gap (11) which permits passage of the strap tongue (2) in the downward direction, that down either end down the cravat is provided a snatch lap (12)(13), one of them fitted with a row of button (1311)(1312)(1313) on the reverse side, the other lap fitted with counterbuttons (1211)(1212)(1213) by symmetry, on either end on the top of the cravat is provided a fastening belt (14)(15) complete with a button (141) and a counterbutton (151) respectively.

We go on with a description of the size of each part of the invention device, supposing that the top-to-base width of the cravat (1) is fixed to 4 cm, then the side-by-side width on the upper side thereof, 2.1 times as large, will be approximately 8.4 cm, and the side-by-side width on the lower side thereof, that is, the clearance between the respective outstanding point of snatch laps, 1.4 times as large, will be about 5.6 cm, the interior side of the snatch lap (12)(13) each pointing down by a slope of minus 57 degrees, of a length that is about 0.4 times the top-to-base width of the cravat (1), approximately 1.6 cm or so, whilst the base side, flat enough, has a width corresponding to half the same top-to-base width of the cravat, that is, approximately 2 cm or so, with the outstanding side pointing down by a slope of minus 70 degrees, so that altogether the cravat appears to be laterally symmetrical in execution.

Figure 3:
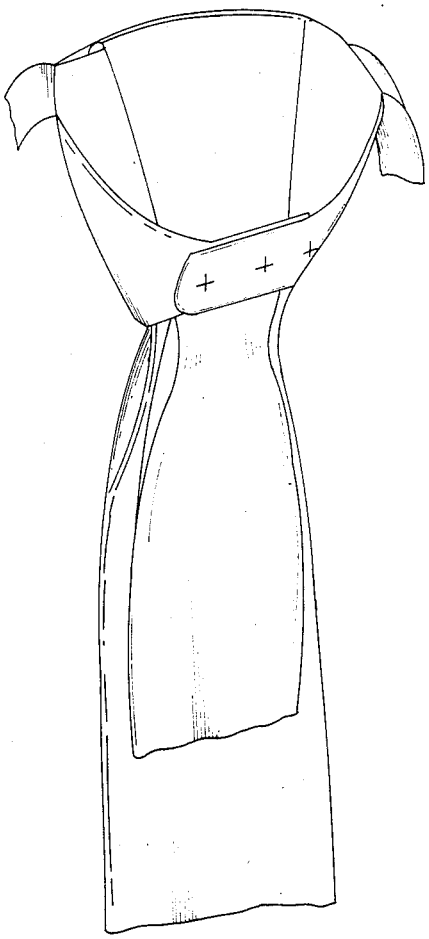
FIG. 3 is a preferred, but non-limiting embodiment of the present invention.
Figure 4:
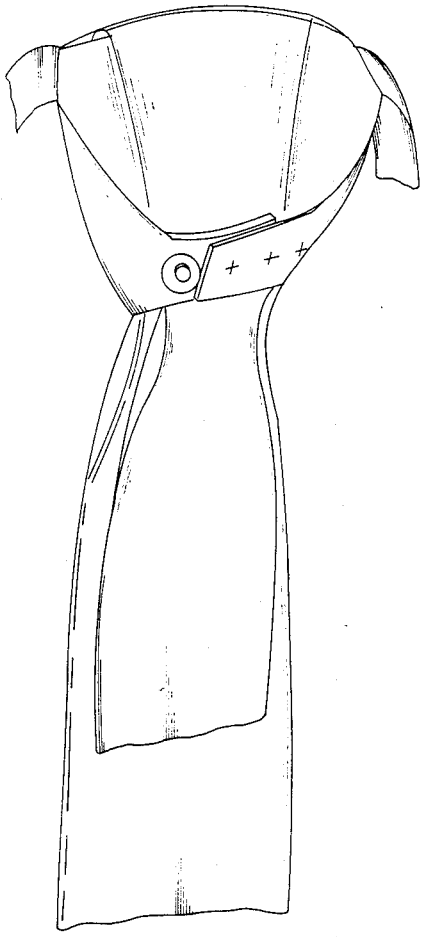
FIG. 4 is another preferred, but non-limiting embodiment of the present invention.
Figure 5:
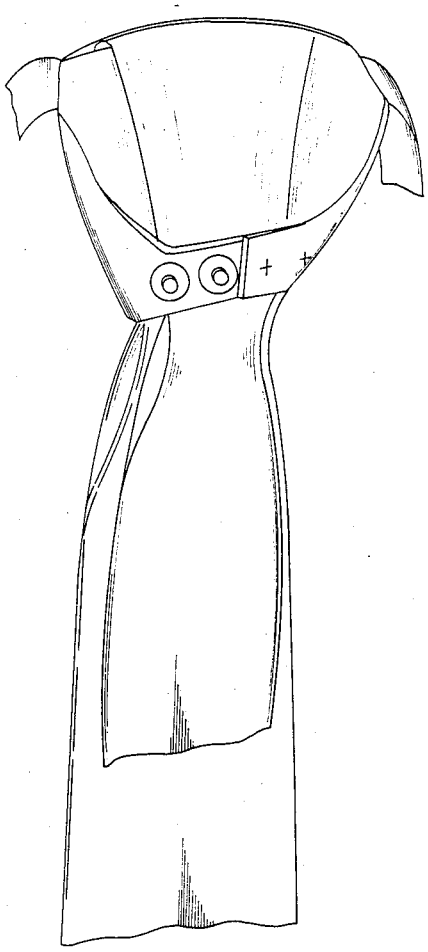
FIG. 5 is still another preferred, but non-limiting embodiment of the present invention.

To put on the invention necktie, the strap tongue (2) has to go through the interim gap (11) on the cravat (1) from the bottom side up, while keeping suitable length of the strap tongue (2) below the interim gap (11), that portion of the strap tongue leaving the upper side of the interim gap (11) to be bent toward the backside of the cravat (1), this being done, the cravat (1) is bent to accommodate coupling of the row of counterbutton (1213)(1212)(1211) with the row of button (1311)(1312)(1313) fitted to the snatch lap (12)(13) respectively, thereby rendering a tough, stately look, duly arcuated, of the cravat, whereupon the cravat (1) and the strap tongue (2) are united together for ready wearing, we further proceed to relate to the procedure for adjustment of the cravat (1) in relation to the collar of a shirt worn by the user:

Step 1: effect coupling of each of the counterbuttons (1213)(1212)(1211) on snatch lap (12) to each of the buttons (1311)(1312)(1313) on snatch lap (13), this will form a cravat (1) having relatively smaller arcuated curve on the periphery owing to relatively more overlapping brought about by snatch laps (12)(13) altogether; like what is shown in FIG. 3;

Step 2: effect coupling of counterbuttons (1212)(1211) on the snatch lap (12) with buttons (1311)(1312) on the snatch lap (13) respectively, this will form a cravat (1) having a relatively larger size owing to relatively lesser coverage of the overlapping of snatch laps (12)(13) with respect to each other, like what is shown in FIG. 4;

Step 3: By coupling the counterbutton (1211) on the snatch lap (12) alone to the button (1311) on the snatch lap (13), one will realise a biggest cravat (1) possible with the invention, like what is shown in FIG. 5.

Once the length of the strap tongue (2) and the size of the cravat (1) have been adjusted all right, the invention necktie is in a position to be worn across the neck of the user by means of fastening belts (14)(15), the last procedure involves coupling of button (151), counterbutton (141) to accommodate hanging of the strap tongue (2) straight down on the chest of the user.

It appears to and it is believed by the inventor that a necktie of the construction disclosed hereinbefore was never heard of, nor seen anywhere in the market or on any publications whatsoever, so it is submitted herewith for a petent permit by virtue of its many advantageous features disclosed hereinbegore.

I claim:

1. Improved structure of the necktie, characterised in the provision of an interim gap on the upper side of the cravat thereof to permit passage of the strap tongue thereof; also of a snatch lap on either corner on the base of the cravat, one such snatch lap provided with a row of button on the frontal side, the other lap provided with a row of counterbutton on the backside by symmetry, such that both laps can be brought together by twisting altogether in the same direction; also of a fastening belt attached to either corner on the upper side of the cravat, one such belt provided with a button on the free end, the other such belt provided with a counterbutton on the free end, altogether serving to hold the necktie in position when worn by the user around the nape.

2. Improved structure of the necktie, according to claim 1, characterised in that the size of respective dimension of the cravat as related to each other is such that supposing that the top-to-base width thereof is 4 cm, the side-by-side width thereof, 2.1 times as large, will be about 8.4 cm, the top side, 1.4 times as large, will be 1.6 cm, also that either of the two snatch laps point down interiorly by a slope of minus 57 degrees, each of a length about 0.4 times the top-to-base width referred to hereinbefore, in this case it is approximately 1.6 cm, the width side of such snatch lap, flat-trimmed, is about 0.5 times the dimension of the same top-to-base reference dimension, that is, about 2 cm in the present case, with respective outstanding rim pointing down by a slope of minus 70 degrees respectively.

* * * * *